US011396439B2

(12) United States Patent
Oh

(10) Patent No.: US 11,396,439 B2
(45) Date of Patent: Jul. 26, 2022

(54) TAPE DISPENSER HAVING FIXING LEVER

(71) Applicant: Yong Chul Oh, Seoul (KR)

(72) Inventor: Yong Chul Oh, Seoul (KR)

( * ) Notice: Subject to any disclaimer, the term of this patent is extended or adjusted under 35 U.S.C. 154(b) by 0 days.

(21) Appl. No.: 16/760,022

(22) PCT Filed: Dec. 27, 2018

(86) PCT No.: PCT/KR2018/016762
§ 371 (c)(1),
(2) Date: Apr. 28, 2020

(87) PCT Pub. No.: WO2020/032332
PCT Pub. Date: Feb. 13, 2020

(65) Prior Publication Data

US 2021/0147170 A1 May 20, 2021

(30) Foreign Application Priority Data

Aug. 6, 2018 (KR) ..... 10-2018-0091337

(51) Int. Cl.
*B65H 35/00* (2006.01)

(52) U.S. Cl.
CPC ..... *B65H 35/0026* (2013.01); *B65H 35/0073* (2013.01); *B65H 2301/5154* (2013.01); *B65H 2301/51532* (2013.01); *B65H 2701/377* (2013.01)

(58) Field of Classification Search
CPC ..... B65H 35/0026; B65H 35/0073
See application file for complete search history.

(56) References Cited

U.S. PATENT DOCUMENTS 5,164,038 A * 11/1992 Sundqvist ..... B65H 35/0033 156/577
5,759,342 A * 6/1998 Luhman ..... B65H 35/0026 156/577
8,413,703 B2 * 4/2013 Yu Chen ..... B65H 35/0033 156/527
10,150,638 B2 * 12/2018 Oh ..... B65H 35/008
(Continued)

FOREIGN PATENT DOCUMENTS

JP h10-157911 * 6/1998
KR 10-2014-0128727 11/2014
(Continued)

*Primary Examiner* — Evan H MacFarlane
*Assistant Examiner* — Liang Dong
(74) *Attorney, Agent, or Firm* — Patent Office of Dr. Chung Park

(57) ABSTRACT

Disclosed is a tape dispenser for cutting tape, while the tape is being unwound by rotation of a tape roll, including: a fixing part coming into close contact with an outer peripheral surface of the tape roll so as to fix the tape roll thereto; a fixing lever to which a given force is applied so that the fixing part rotates to come into close contact with the outer peripheral surface of the tape roll; a rotating shaft connected to the fixing lever and rotating to come into close contact with the outer peripheral surface of the tape roll; an extended part for connecting the fixing part and the rotating shaft with each other; and a close-fitting member disposed on the inner side of the tape roll so as to apply a given force to the tape roll in one direction.

5 Claims, 9 Drawing Sheets

(56) References Cited

U.S. PATENT DOCUMENTS

| | | | | |
|---|---|---|---|---|
| 2003/0094243 | A1* | 5/2003 | Charriere | B65H 35/0033 156/577 |
| 2009/0007207 | A1 | 3/2009 | Lucht | |
| 2010/0193539 | A1 | 8/2010 | Fathi | |

FOREIGN PATENT DOCUMENTS

| | | |
|---|---|---|
| KR | 10-2017-0032156 | 3/2017 |
| KR | 10-1778109 | 9/2017 |

* cited by examiner

TAPE DISPENSER HAVING FIXING LEVER

CROSS-REFERENCE TO RELATED APPLICATIONS

This application is a national stage application of International Patent Application No. PCT/KR2018/016762 filed on Dec. 27, 2018, which claims priority to Korean Patent Application No. 10-2018-0091337 filed on Aug. 6, 2018, the entire contents of which are incorporated by reference herein.

TECHNICAL FIELD

The present invention relates to a tape dispenser, and more particularly, to a tape dispenser that is capable of being provided with a fixing lever for fixing a tape roll thereto, thereby preventing tape from shaking at the time when the tape is cut.

BACKGROUND

If it is desired to pack a box in which goods is put, generally, tape is attached to a cut portion on top of the box.

Such box taping is typically carried out by a worker's manual work with a roller type tape dispenser.

In case of the conventional roller type tape dispenser, however, a blade is located horizontally, and upon cutting of tape, accordingly, a cutting force is not transferred efficiently to the tape, so that since the tape is not cut at a time, it has to be cut with forces applied several times.

So as to solve the above-mentioned problems, another conventional tape dispenser is disclosed in Korean Patent No. 10-1649461 entitled "tape dispenser" and issued to the same applicant as this invention, and in this case, a blade is located at a given inclination to improve a cutting force, so that when compared with the conventional practice, the blade can cut the tape at a time more easily, thereby improving an efficiency in taping work.

According to the above-mentioned prior art, in detail, if the tape dispenser is moved along a desired attachment portion by a worker, a tape roll rotates to unwind the tape so that the tape is attached to the attachment portion. If the attachment of the tape to the attachment portion is finished, the tape can be cut by a desired length at the corresponding position by means of the blade.

In this case, a given force is applied to the tape dispenser so as to cut the tape, and at this moment, the tape may shake, so that frequently, it is not cut at a desired position or a cut edge thereof is not evenly formed.

Accordingly, the conventional tape dispenser is provided with a fixing lever for fixing the tape so as to prevent the tape from shaking, and at a time when the tape is cut, the fixing lever serves to fix the tape thereto, thereby allowing the tape to be stably cut.

So as to prevent the rotation of the tape roll from being hindered, in this case, the fixing lever of the tape dispenser has to be not kept in close contact with the tape except when the tape is cut.

In the conventional tape dispenser, accordingly, an elastic spring structure is generally adopted to permit the fixing lever to be kept apart from the surface of the tape roll.

In case of the conventional tape dispenser where the spring structure is adopted, however, a material cost is raised due to the purchase of a separate spring, and an additional process of inserting the spring is needed, thereby undesirably causing process complexity and increment in manufacturing cost.

In case of the long-term use of the spring, further, the elasticity of spring may be lost due to the aging of the spring to cause the function of fixing the tape to be erroneously provided and also to fail to allow the fixing lever to be kept apart from the surface of the tape roll, so that the tape roll may be hindered from rotating.

SUMMARY

Accordingly, the present invention has been made in view of the above-mentioned problems occurring in the related art, and it is an object of the present invention to provide a tape dispenser that is capable of allowing a tape roll fitted thereto to be adjusted in tension, thereby achieving firm packing, allowing tape to be fixed to a fixing lever at the time when the tape is cut, thereby cutting the tape at a user's desired length and position accurately and clearly, and needing no spring structure on the fixing lever for fixing the tape roll thereto.

To accomplish the above-mentioned object, according to the present invention, there is provided a tape dispenser for cutting tape, while the tape is being unwound by rotation of a tape roll, including: a fixing part coming into close contact with an outer peripheral surface of the tape roll so as to fix the tape roll thereto; a fixing lever to which a given force is applied so that the fixing part rotates to come into close contact with the outer peripheral surface of the tape roll; a rotating shaft connected to the fixing lever and rotating to come into close contact with the outer peripheral surface of the tape roll; an extended part for connecting the fixing part and the rotating shaft with each other; and a close-fitting member disposed on the inner side of the tape roll so as to apply a given force to the tape roll in one direction.

According to the present invention, desirably, the rotating shaft rotates in the direction opposite to the rotational direction of the tape roll when the tape roll rotates, such that the fixing lever and the extended part rotate by a predetermined distance in the same direction as the rotational direction of the rotating shaft, and thus the fixing part is moved in a direction away from the outer peripheral surface of the tape roll.

According to the present invention, desirably, the fixing part includes a contact member and a contact member support, and the contact member is made of an elastic material having a longitudinal shape.

According to the present invention, desirably, the extended part and the fixing lever have a given angle around the rotating shaft in the direction opposite to the tape roll.

According to the present invention, desirably, the tape dispenser further includes a blade cap disposed above a blade, one end of the blade cap being rotatably fixed so that if the blade cap is rotated upward and erected, the blade cap is fixed at the erected state, and if the blade cap is rotated downward, the blade cap is fixed in a state of covering the blade.

According to the present invention, desirably, the tape dispenser further includes fixing bars disposed under the blade and made of an elastic material in such a manner as to become decreased in thickness toward the ends thereof.

According to the present invention, desirably, the tape dispenser further includes an attaching member having a given length in a transverse direction on one side end of the underside of a grip.

BRIEF DESCRIPTION OF THE DRAWINGS

The above and other objects, features and advantages of the present invention will be apparent from the following detailed description of the embodiments of the invention in conjunction with the accompanying drawings, in which.

S. 1A and 1B are perspective views showing a tape dispenser having a fixing lever according to the present invention.

DETAILED DESCRIPTION OF THE DISCLOSURE

Figure 1A:
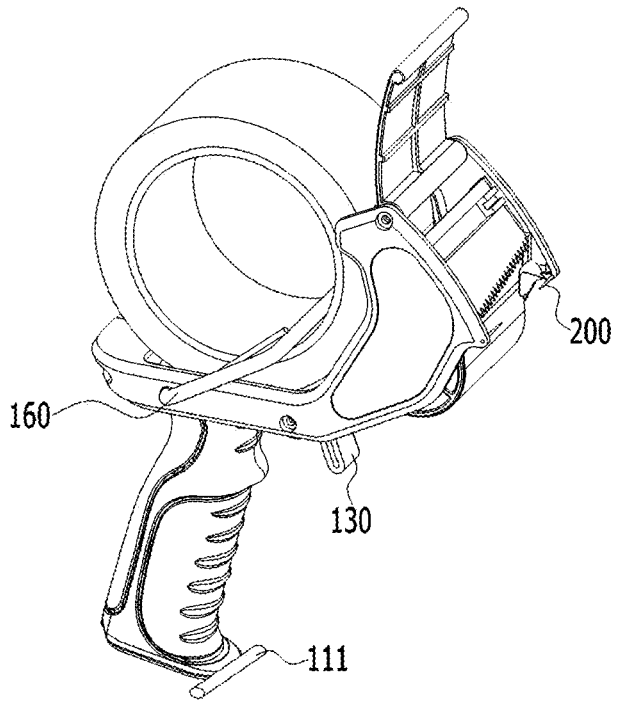

The present invention is disclosed with reference to the attached drawings wherein the corresponding parts in the embodiments of the present invention are indicated by corresponding reference numerals and the repeated explanation on the corresponding parts will be avoided.

In the description, when it is said that one portion is described as "includes" any component, one element further may include other components unless no specific description is suggested.

Hereinafter, an explanation on a tape dispenser having a fixing lever according to the present invention will be in detail given.

Figure 1B:
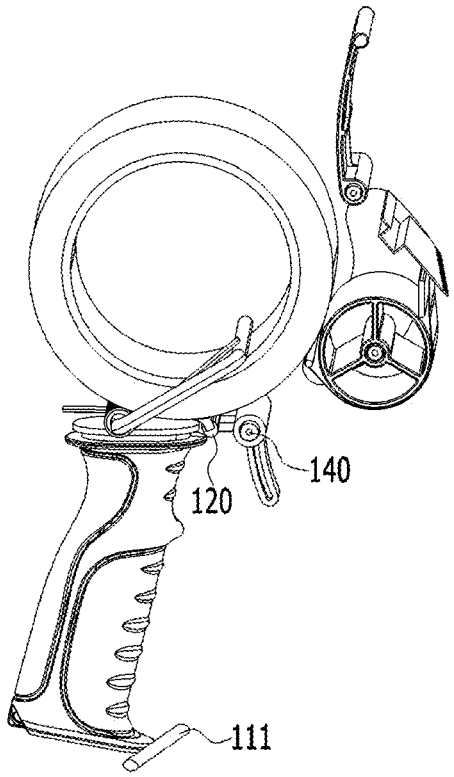

FIGS. 1A and 1B are perspective views showing a tape dispenser having a fixing lever according to the present invention.

First, FIG. 1A shows the entire outer appearance of a tape dispenser 1 having a fixing lever 130 according to the present invention.

As shown, the fixing lever 130 is located under a tape roll 2, and if it is desired to cut unwound tape, a given force is applied to the fixing lever 130 to pull the fixing lever 130, so that the tape roll 2 is fixed to the fixing lever 130.

Further, a close-fitting member 160 is provided in such a manner as to come into close contact with the inner peripheral surface of the tape roll 2.

The close-fitting member 160 has an elastic spring 161 fitted thereto in such a manner as to continuously apply a force for pushing the tape roll 2 from the inside toward the outside.

As a result, the tape roll 2 is slightly pushed toward the outside, and thus, it can be kept in close contact with a rotating shaft 140.

A blade cap 190 whose one side is fixed is openable and closeable so that it is open if it is desired to use the tape dispenser and it is closed while the tape dispenser is being not used.

Fixing bars 200, which are made of a rubber material, protrude from the inner sides of left and right external cases under a blade.

Generally, the cut end of the tape sags down, and upon next work, accordingly, it should be lifted up, so that undesirably, it is inconvenient to use a user's both hands together.

However, the fixing bars 200 serve to prevent the cut end of the tape from sagging down, thereby having no need to lift the cut end of the tape. Accordingly, the tape dispenser according to the present invention can be easily used with the user's one hand.

Further, the fixing bars 200 are made of the rubber material having given elasticity, so that they can be bent well. If the unwound tape is moved up and down, it can be easily passed through the fixing bars 200, thereby ensuring more convenient work.

FIG. 1B briefly shows an inner appearance of the tape dispenser 1 having the fixing lever 130 according to the present invention, wherein the left and right external cases coupled to both side surfaces of the tape dispenser 1 are removed.

As shown, the rotating shaft 140 desirably has a shape of a cylinder whose surface is flat and is located close to one side underside of the tape roll 2. In more detail, the rotating shaft 140 is desirably kept in close contact with one side underside of the tape roll 2 slightly pushed by means of the close-fitting member 160.

An extended part 150 and the fixing lever 130 have a given angle around the rotating shaft 140, while being connected to the outer peripheral surface of the rotating shaft 140, and further, a fixing part 120 is located at the end of the extended part 150, so that the fixing lever 130 constituted of the rotating shaft 140, the extended part 150 and the fixing part 120 is provided to fix the tape roll 2.

A noise prevention part 180 has a shape of a thin cylindrical bar located between a roller 5 and the tape roll 2 and fixedly comes into close contact with the roller 5.

The noise prevention part 180 serves to pressurize a point at which the tape is detached from the tape roll 2 to reduce noise generated when the tape is detached.

Figure 2:
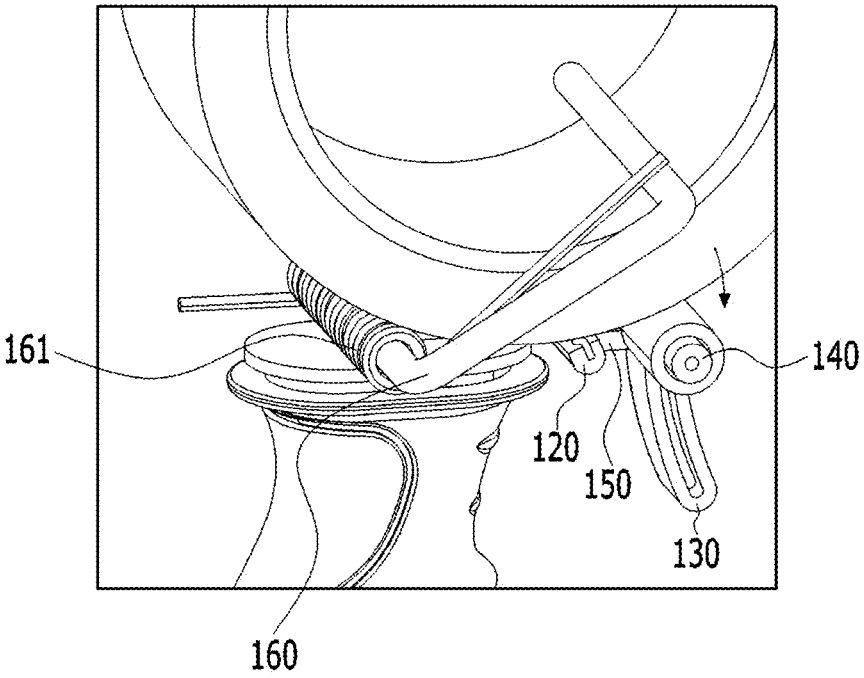
FIG. 2 is an enlarged perspective view showing a portion where the fixing lever is located when the tape dispenser according to the present invention is viewed on one side.

FIG. 2 is an enlarged perspective view showing a portion where the fixing lever 130 is located when the tape dispenser according to the present invention is viewed on one side.

As shown, the close-fitting member 160 is located close to the inner peripheral surface of the tape roll 2, and the spring 161 is fitted to the close-fitting member 160 to apply an outward elastic force from the inner peripheral surface of the tape roll 2.

Through the formation of the spring 161, the close-fitting member 160 pushes the tape roll 2 in a direction of an arrow, that is, in a direction toward the rotating shaft 140, so that one side surface of the tape roll 2 can be kept into close contact with one side surface of the rotating shaft 140.

The close-fitting member 160 is not particularly limited in material and shape only if it can apply a force for pushing the tape roll 2 in the direction of the arrow to the tape roll 2.

Also, the rotating shaft 140 is located close to one side underside of the tape roll 2 so that it can be kept in close contact with the surface of the tape roll 2 slightly pushed by the close-fitting member 160.

Further, the extended part 150 is extended from the rotating shaft 140 in a longitudinal direction, while having the given angle with respect to the fixing lever 130, and the fixing part 120 is located at the end of the extended part 150.

The fixing part 120 comes into close contact with the surface of the tape roll 2 to apply a frictional force and a pressure to the tape roll 2.

In this case, the fixing part 120 includes a contact member 121 coming into direct contact with the surface of the tape roll 2 and a contact member support 122 for supporting and fixing the contact member 121.

Particularly, one end of the contact member 121 coming into contact with the tape roll 2 is protrudingly bent to a given angle in one direction.

If the fixing lever 130 is pulled to allow the contact member 121 to come into contact with the surface of the tape roll 2, accordingly, the end of the protruding portion of the contact member 121 first comes into contact with the surface of the tape roll 2.

If the fixing lever 130 is slightly pulled, only the end of the protruding portion of the contact member 121 comes into contact with the surface of the tape roll 2, and if the fixing lever 130 is gradually and strongly pulled, the contact member 121 coming into close contact with the surface of the tape roll 2 becomes enlarged in area.

Through a degree of pulling the fixing lever 130, in detail, the contacted area of the contact member 121 with the surface of the tape roll 2 can be adjusted, thereby controlling a frictional force applied to the tape roll 2, so that a fixing force for fixing the tape roll 2 can be appropriately adjusted in accordance with working characteristics of the user.

Further, the contact member 121 is made of an elastic material so that if it comes in contact with the tape roll 2, it is bent well, and even if the fixing lever 130 is pulled with a strong force, accordingly, the contact member 121 is not easily damaged or broken.

In conclusion, the fixing lever 130 is pulled to allow the contact member 121 to come into contact with the surface of the tape roll 2, and accordingly, the frictional force is generated to cause the tape roll 2 to rotate tightly, so that the unwound tape can be kept with high tension, which permits the tape to be evenly attached to a given attachment surface, without any curling.

If it is desired to cut the tape, furthermore, the fixing lever 130 is more strongly pulled to allow the pressure and frictional force applied to the tape roll 2 to be greatly increased, so that the tape roll 2 is fixed to the fixing lever 130, without any rotation, thereby permitting the tape to be cut by a desired length at an accurate position.

The contact member support 122 is not particularly limited in material, but desirably, it is made of a material having given durability so that while the contact member support 122 is firmly fixing and supporting the contact member 121, even if a force is applied thereto, the contact member support 122 is not damaged or broken.

Further, concave-convex patterns or embossed protrusions are repeatedly formed on the contact surface of the contact member 121 with the tape roll 2, thereby increasing the frictional force therebetween.

In this case, the extended part 150 and the fixing lever 130 are located on the outer peripheral surface of the rotating shaft 140 and are spaced apart from each other by a given distance, so that they have the given angle around the rotating shaft 140.

Further, the extended part 150 and the fixing lever 130 are fixedly connected to the outer peripheral surface of the rotating shaft 140, and if the rotating shaft 140 rotates, they rotate together by the same distance and in the same direction as the rotational distance and direction of the rotating shaft 140, while keeping the given distance therebetween.

Accordingly, the fixing part 120 operates in response to the operation of the rotating shaft 140, and the operation of the rotating shaft 140 is varied by means of the rotation of the fixing lever 130 or the tape roll 2.

Figure 3:
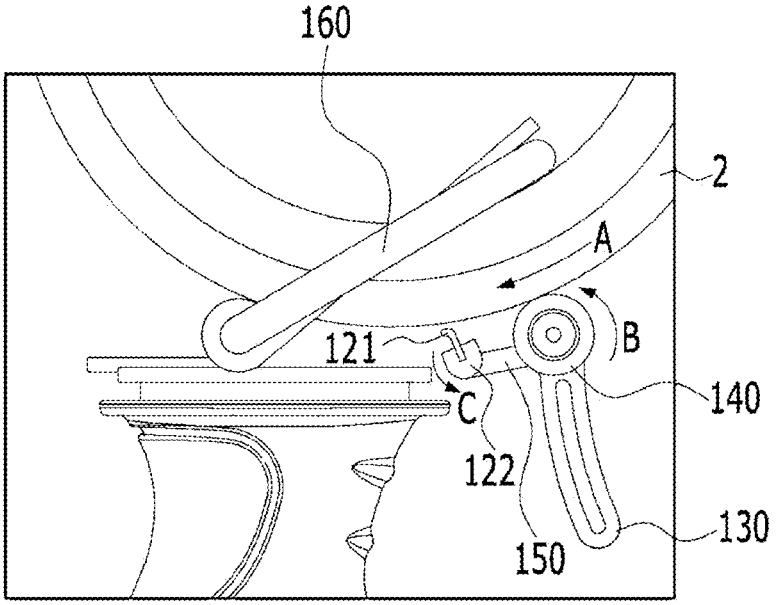
FIG. 3 is a perspective view showing an operation of the fixing lever when a tape roll rotates in the tape dispenser according to the present invention.
Figure 4:
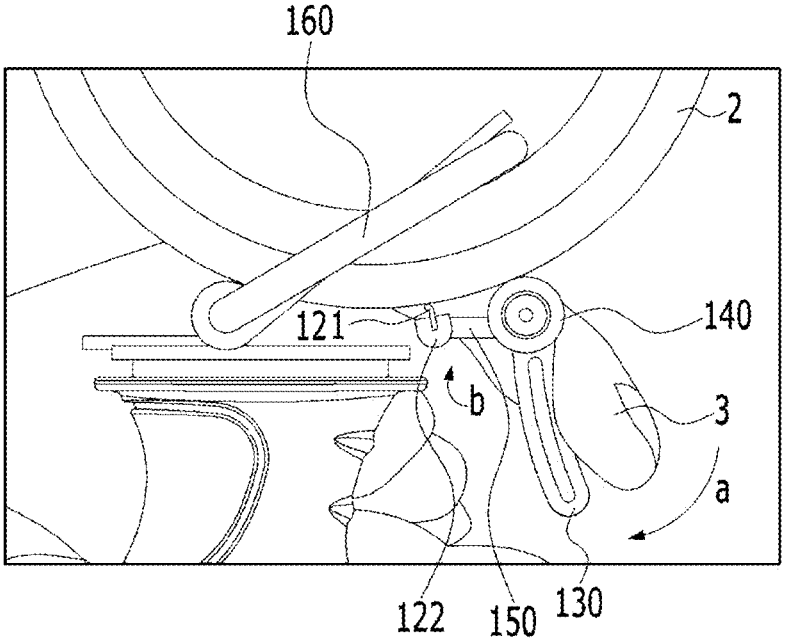
FIG. 4 is a perspective view showing an operation of the fixing lever when tape is cut in the tape dispenser according to the present invention.

FIGS. 3 and 4 show operations of the fixing lever 130. In detail, FIG. 3 is a perspective view showing an operation of the fixing lever 130 when the tape roll 2 rotates, and FIG. 4 is a perspective view showing an operation of the fixing lever 130 when the tape is cut.

Referring first to FIG. 3, as the tape roll 2 rotates in a direction of 'A', the tape becomes unwound.

In this case, the close-fitting member 160 continuously applies the elastic force to the tape roll 2 in a direction where the rotating shaft 140 is located, so that as the tape roll 2 is slightly pushed in the direction of the rotating shaft 140, one side underside surface of the tape roll 2 comes into close contact with one side top surface of the rotating shaft 140.

At this time, the rotating shaft 140 rotates in a direction of 'B' by means of the frictional force generated from the contacted portion between the tape roll 2 and the rotating shaft 140, and accordingly, the fixing part 120, which is fixedly connected to one side outer peripheral surface of the rotating shaft 140 by means of the extension part 150, rotates in a direction of 'C', which is the same as the rotational direction and distance of the rotating shaft 140.

As a result, the fixing part 120 is spaced apart from the surface of the tape roll 2, so that while the tape roll 2 is rotating, the fixing part 120 does not come into close contact with the surface of the tape roll 2, thereby not allowing the tape roll 2 to be hindered from rotating.

The state where the fixing part 120 is spaced apart from the surface of the tape roll 2 is kept during the tape roll 2 rotates, so that the tape is unwound by the user's desired length from a time point where the tape roll 2 rotates and is thus continuously unwound naturally, without any hindering, up to a time point where the rotation of the tape roll 2 is stopped.

In this case, if a concave-convex pattern is formed on the surface of the rotating shaft 140 to more easily generate a frictional force between the surface of the tape roll 2 and the surface of the rotating shaft 140, the tape roll 2 may be damaged by the concave-convex pattern formed on the rotating shaft 140, while rotating, and accordingly, the surface of the rotating shaft 140 becomes desirably flat.

As the surface of the rotating shaft 140 becomes flat, on the other hand, the frictional force may be not generated, so that even if the tape roll 2 rotates, the rotating shaft 140 may not rotate. However, the frictional force is determined upon a force and a friction coefficient applied between two objects, and even if the surface of the rotating shaft 140 is flat to make the friction coefficient relatively low, a force is applied between the tape roll 2 and the rotating shaft 140 by means of the elastic force of the close-fitting member 160 to generate a frictional force, so that through the frictional force, the rotating shaft 140 can rotate.

Even though the surface of the rotating shaft 140 is flat, accordingly, the rotating shaft 140 can rotate by means of the rotation of the tape roll 2.

Referring now to FIG. 4, if the tape is unwound by a desired length, the movement of the tape dispenser is stopped by the user, and accordingly, the rotation of the tape roll 2 is stopped.

If the fixing lever 130 is pulled in a direction of 'a' by means of the user's finger 3, at this time, the rotating shaft 140 also rotates in the direction of 'a', and accordingly, the extended part 150 fixedly connected to the rotating shaft 140 rotates in a direction of 'b'.

As a result, the contact member 121 comes into close contact with a portion of the underside surface of the tape roll 2.

If the fixing lever 130 is kept in a pulled state even after the contact member 121 comes into close contact with a portion of the underside surface of the tape roll 2, the user's force applied to the fixing lever 130 is transferred to the tape roll 2 through the contact member 121 of the fixing part 120, thereby applying a pressure and a frictional force to the surface of the tape roll 2.

Further, the contact member 121 is desirably made of a material having a high friction coefficient such as rubber, silicone, and so on, and through the frictional force generated between the tape roll 2 and the contact member 121, the contact member 121 applies the frictional force to the tape roll 2, without any slip on the surface of the tape roll 2.

Figure 5B:
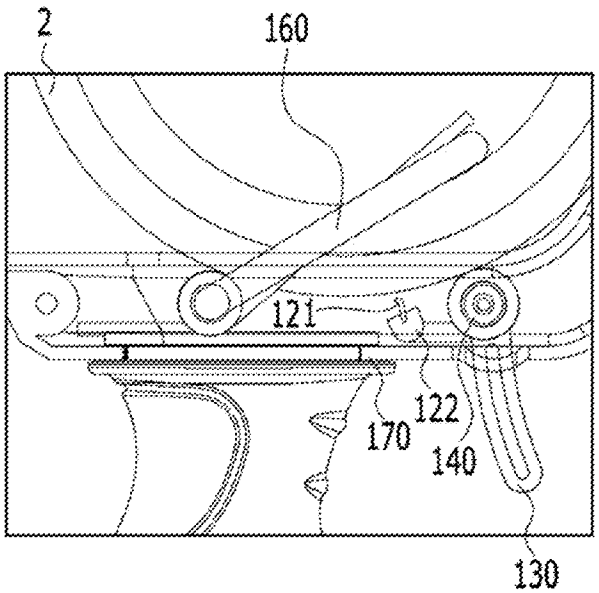
FIGS. 5A and 5B are perspective and side views showing support parts of the tape dispenser according to the present invention.
Figure 5A:
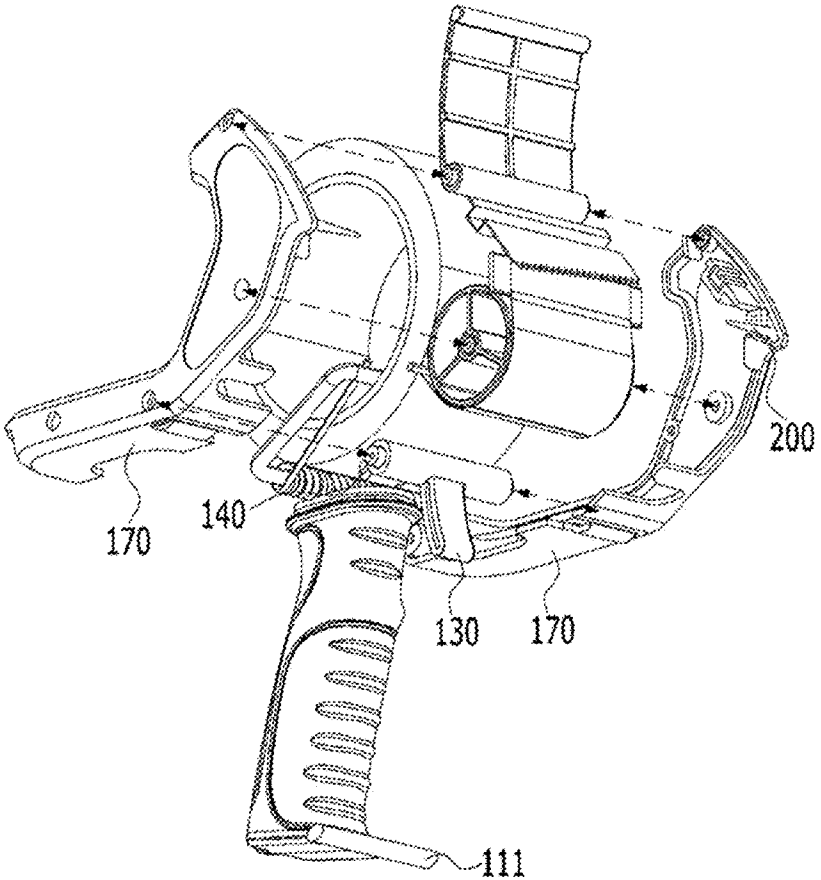

FIGS. 5A and 5B are perspective and side views showing support parts 170 for preventing the contact member 121 from being spaced apart from the surface of the tape roll 2 by a given distance longer than necessary.

During the tape roll 2 rotates, as mentioned above, the rotating shaft 140 also rotates to allow the contact member 121 to become distant from the surface of the tape roll 2, and as the tape roll 2 rotates by the desired length of the tape, generally, it continuously rotates even after the contact member 121 becomes distant from the surface thereof.

Accordingly, the contact member 121 become more distant than necessary, which causes even the fixing lever 130 connected to the rotating shaft 140 to rotate more than necessary, so that the fixing lever 130 becomes very close to a body of the tape dispenser, and if it is desired to pull the fixing lever 130 by the user, a space to which his or her finger is insertedly fitted cannot be sufficiently ensured.

Accordingly, there is a need for a configuration capable of preventing the contact member 121 from being spaced apart from the outer peripheral surface of the tape roll 2 by a given distance longer than necessary, and such a configuration will be in detail explained with reference to FIGS. 5A and 5B.

As shown in FIG. 5A, the left and right external cases are fittedly coupled to the left and right sides of the tape dispenser at portions indicated by dotted arrows.

In this case, bottom ends of the left and right external cases are extended at right angles to wall surfaces thereof to form a bottom of the body of the tape dispenser.

If the left and right external cases are contactedly coupled to each other, accordingly, the bottoms thereof are formed as a bottom surface of the body of the tape dispenser that is adapted to separate the inside and outside of the body of the tape dispenser, as shown in FIG. 5B.

At this time, the fixing part 120 is located at the interior of the body of the tape dispenser and is close to the support parts 170, so that it is limited in rotating distance by means of the support parts 170.

When the tape roll 2 rotates, in detail, the rotating shaft 140 also rotates to allow the contact member 121 of the fixing part 120 to be spaced apart from the surface of the tape roll 2, and if the contact member 121 is spaced apart from the surface of the tape roll 2 by a given distance, the support parts 170 located under the fixing part 120 cut off the rotation of the fixing part 120, so that the contact member 121 is not spaced apart anymore from the surface of the tape roll 2.

Accordingly, the support parts 170 prevent the contact member 121 from being spaced apart from the surface of the tape roll 2 by a distance longer than necessary and also keeps a sufficient space between the fixing lever 130 and the body of the tape dispenser, into which the user's finger is insertedly fitted to allow the fixing lever 130 to be easily pulled thereby.

In case of the blades of the conventional tape dispensers, on the other hand, big noise is generated during the tape is unwound and detached from the tape roll.

This is because an area of contact surface of the tape detached at a time is large when the tape is detached from the tape roll.

According to the present invention, the noise prevention part 180 is adapted to reduce the noise generated when the tape is detached from the tape roll 2.

Figure 6:
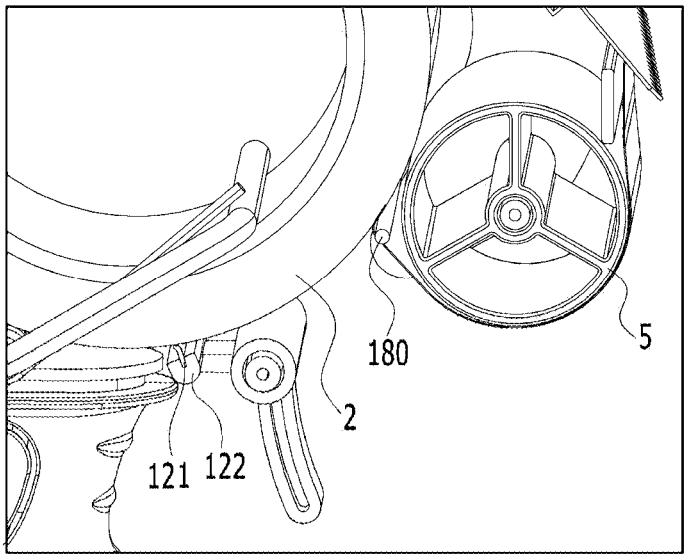
FIG. 6 is a perspective view showing a portion where a noise prevention part is located in the tape dispenser according to the present invention.

As shown in FIG. 6, the noise prevention part 180 has a shape of a thin cylindrical bar located between the roller 5 and the tape roll 2 in such a manner as to fixedly come into close contact with the roller 5.

As the noise prevention part 180 is fixed to the roller 5, it pressurizes a point at which the tape is detached from the tape roll 2 during the tape is unwound from the tape roll 2, so that an area of contact surface of the tape detached at a time can be reduced.

As a result, the noise generated when the tape is detached from the tape roll 2 through the rotation of the tape roll 2 can be greatly reduced.

Also, the noise prevention part 180 is kept in close contact with the roller 5, and even if it has the shape of the thin cylindrical bar, accordingly, it is not easily bent. As a result, the noise prevention part 180 can ensure long-term use, without any bending.

Figure 7C:
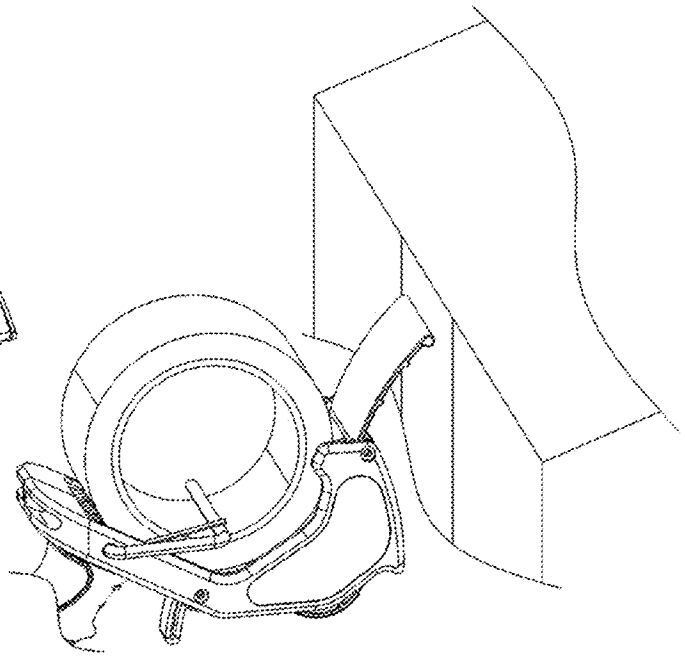
FIGS. 7A to 7C are perspective views showing states where a blade cap is open and closed in the tape dispenser according to the present invention operations.
Figure 7B:
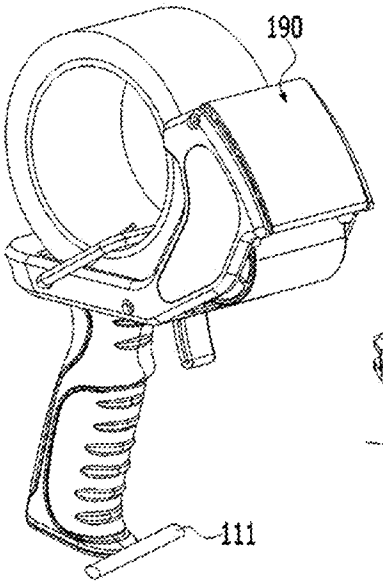
Figure 7A:
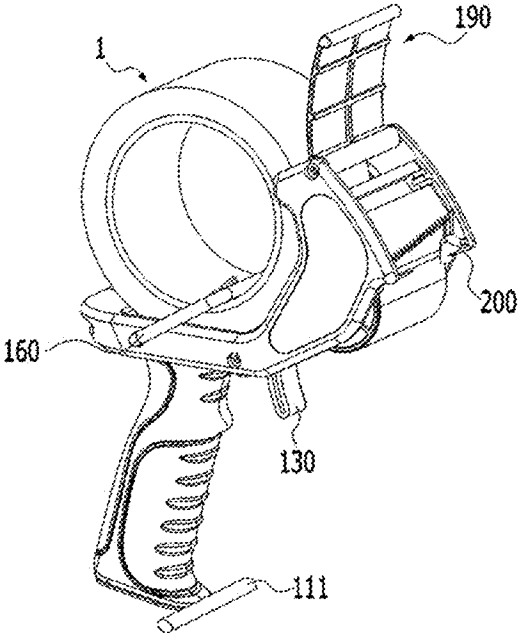

FIGS. 7A to 7C are perspective views showing states where the blade cap 190 is open and closed in the tape dispenser according to the present invention operations.

The blade cap 190 is openable and closable, and if the blade is not used, as shown in FIG. 7B, the blade cap 190 is closed onto the blade, thereby preventing safety accidents caused by the blade from occurring.

If the blade is used, as shown in FIG. 7A, the blade cap 190 is erected vertically and is thus open, and after the tape is attached to a given attachment surface, the blade cap 190 can press or rub the attached tape. The process is shown in FIG. 7C.

As shown in FIG. 7C, top of the attached tape is pressed or rubbed by the end of the blade cap 190 open, so that the tape completely comes in close contact with the attachment surface and is gently attached to the attachment surface, without any curling.

Figure 8B:
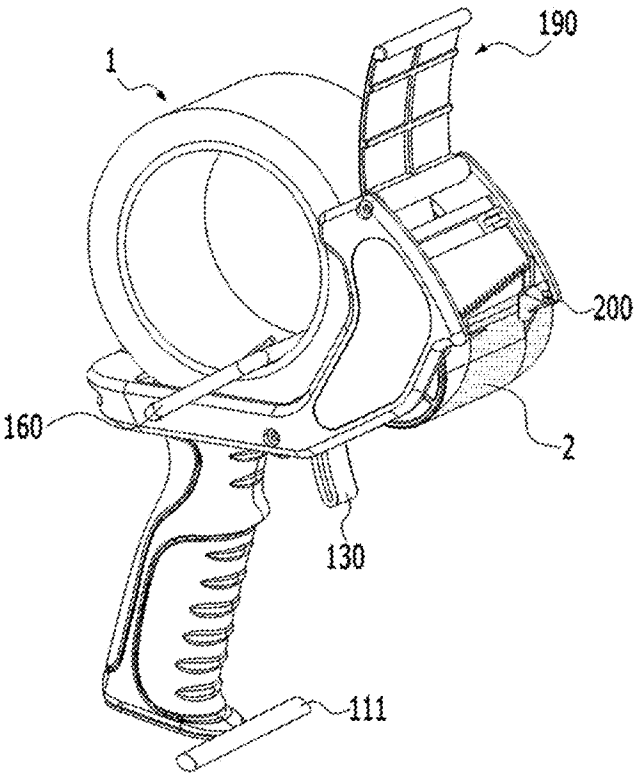
FIGS. 8A and 8B are perspective views showing comparison results between existence and nonexistence of fixing bars in the tape dispenser according to the present invention.
Figure 8A:
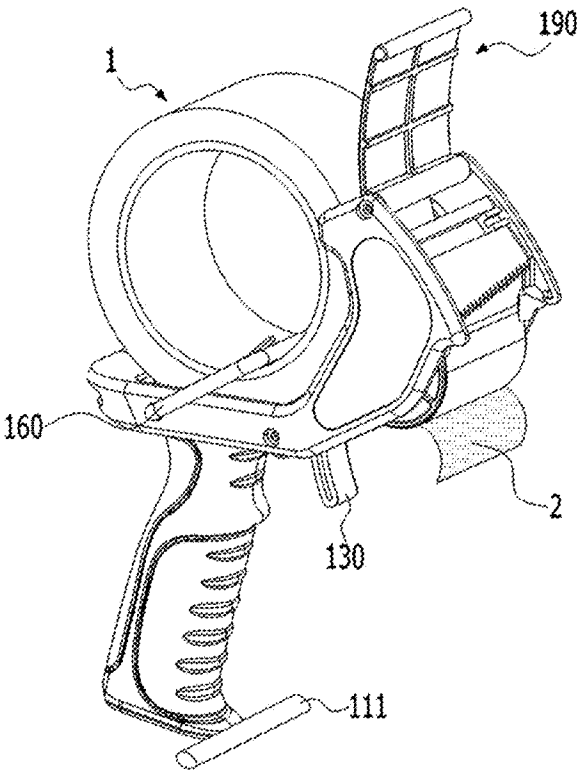

FIGS. 8A and 8B are perspective views showing comparison results between existence and nonexistence of the fixing bars 200.

FIG. 8A shows an example where the fixing bars 200 are not used in the tape dispenser according to the present invention, and as no fixing bars 200 are located under the blade, in this case, the tape unwound from the tape roll 2 may sag down.

In this case, the cut edge of the tape is bent toward the tape dispenser, and accordingly, it is lifted and stretched out by means of a user's other hand which does not hold the tape dispenser. Next, the cut edge of the tape has to be attached to a position of the attachment surface where the attachment starts by means of the user in an inconvenient manner, which makes a working efficiency deteriorated and needs the user's both hands for the work.

If the fixing bars 200 are used as shown in FIG. 8B, however, the cut end of the tape is fixed to the fixing bars 200, so that it does not sag down.

Accordingly, the cut end of the tape is placed on the position of the attachment surface where the attachment starts, and in this state, the attachment is just performed. As a result, the attachment can be achieved by means of the user's one hand, thereby improving the working efficiency.

Figure 9B:
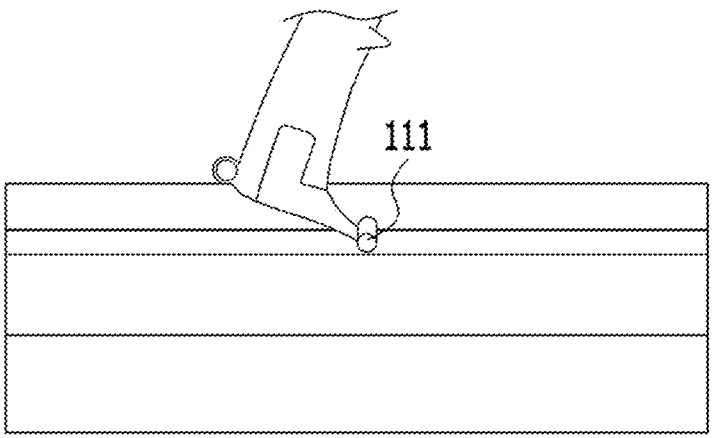
FIGS. 9A and 9B are perspective views showing an attachment member located on a grip in the tape dispenser according to the present invention.
Figure 9A:
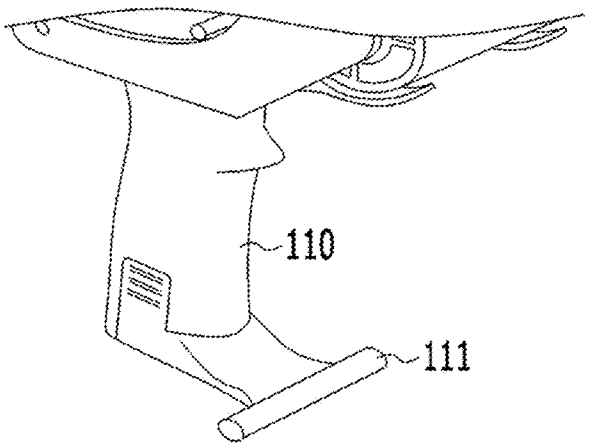

FIGS. 9A and 9B are perspective views showing an attaching member located on a grip in the tape dispenser according to the present invention.

According to the present invention, the tape dispenser has a shape of a general gun, and accordingly, it has a grip 110 like a gun grip, so that through the grip 110, the tape dispenser can be held by the user's hand.

According to the present invention, as shown in FIG. 9A, the tape dispenser further has a bar-like attaching member 111 having a given length in a transverse direction on one side end of the grip 110.

Generally, a package box is taped to protect a product therein from the outside and to prevent the product from escaping, and next, top of the attached tape is rubbed and pressed to enhance an attached degree to the package box.

In this case, generally, the attached tape is pressed by means of the user's other hand which does not hold the tape dispenser, which needs the user's both hands for the taping work.

As shown in FIG. 9A, however, top of the attached tape is rubbed and pressed by means of the attaching member 111, so that it is easy to perform the taping work only with the user's one hand.

In this case, desirably, a length of the attaching member 111 is longer than a width of the tape roll 2 so as to press and rub the entire width of the top surface of the attached tape at a time.

As described above, the tape dispenser having the fixing lever according to the present invention can adjust the tension of the tape fitted thereto through the fixing lever when the tape is unwound from the tape roll.

If the fixing lever is pulled by the user's finger, in detail, the pulling force is adjusted to allow the fixing lever to control a force for fixing the tape, so that when the tape is unwound, the tension of the tape unwound is adjusted to provide firm packing and perfect attachment of the tape to the attachment surface.

In addition, the fixing lever can be kept apart from the surface of the tape roll during the rotation of the tape roll, without having any spring structure, so that there is a need to have any additional spring structure, thereby making a manufacturing process simple and reducing a manufacturing cost.

In the conventional practice, further, the fixing lever cannot be kept apart from the surface of the tape roll due to the decrement of the elastic force of the spring caused by the repeated expansion and contraction operations thereof, thereby hindering the tape roll from rotating, but according to the present invention, the fixing lever does not have any spring structure, so that the tape roll cannot be hindered from rotating.

Furthermore, the fixing bars are located under the blade, and upon cutting the tape by means of the blade, the tape does not sag down by means of the fixing bars, thereby making it easy to perform the taping work by means of the user's one hand.

Also, the fixing bars are made of the rubber material so that they can be prevented from being damaged, and further, when the tape unwound is moved up and down, the fixing bars are well bent, thereby making it convenient to perform the taping work.

In addition, the cylindrical noise prevention part having a small outer diameter is provided to reduce an area of contact surface of the tape detached at a time, when the tape is unwound from the tape roll, thereby reducing the noise generated when the tape is unwound.

Besides, the openable and closable blade cap is provided so that if the tape dispenser is not used, the blade cap is covered, thereby safely keeping the tape dispenser, and if the tape dispenser is used, the blade cap is erected to press and rub the tape, so that the tape can be evenly attached to the attachment surface.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A tape dispenser comprising:

a support member;

a pressurizing member having a spring;

a rotating shaft rotatably coupled to the support member;

a fixing lever connected with the rotating shaft; and a fixing member connected with the rotating shaft and the fixing member rotating by an operation of the fixing lever about an axis of the rotating shaft, wherein the pressurizing member is configured to pressurize a tape roll, and the rotating shaft is configured to make contact with the tape roll when the pressurizing member pressurizes the tape roll, wherein the support member is configured to limit a rotating distance of the fixing member, wherein, when the tape roll rotates, the rotating shaft is configured to rotate together, and the fixing member is configured to be spaced apart from the tape roll and to rotate only until the fixing member comes into contact with the support member, and wherein the fixing member is configured to make contact with the tape roll by the operation of the fixing lever.

2. The tape dispenser according to claim 1, wherein the fixing member comprises a contact member and a contact member support.

3. The tape dispenser according to claim 1, further comprising a blade, a blade cap disposed above the blade, one end of the blade cap being rotatably fixed so that if the blade cap is rotated upward and erected, the blade cap is fixed at an erected state, and if the blade cap is rotated downward, the blade cap is fixed in a state of covering the blade.

4. The tape dispenser according to claim 1, further comprising a blade and fixing bars disposed under the blade and made of an elastic material.

5. The tape dispenser according to claim 1, further comprising an attaching member having a given length in a transverse direction on one side end of an underside of a grip.

* * * * *